US007959356B2

(12) United States Patent
Sommers

(10) Patent No.: US 7,959,356 B2
(45) Date of Patent: Jun. 14, 2011

(54) SYSTEMS AND METHODS FOR PROVIDING A DYNAMIC LAUNDRY BAG APPARATUS

(76) Inventor: Kristine Sommers, Morgan, UT (US)

( * ) Notice: Subject to any disclaimer, the term of this patent is extended or adjusted under 35 U.S.C. 154(b) by 1189 days.

(21) Appl. No.: 11/594,557

(22) Filed: Nov. 8, 2006

(65) Prior Publication Data

US 2007/0110342 A1 May 17, 2007

Related U.S. Application Data

(60) Provisional application No. 60/735,090, filed on Nov. 8, 2005.

(51) Int. Cl.

| | |
|---|---|
| ***B65D 33/06*** | (2006.01) |
| ***B65D 33/14*** | (2006.01) |
| ***B65D 30/22*** | (2006.01) |
| ***B65D 33/16*** | (2006.01) |
| ***B65D 33/28*** | (2006.01) |

(52) U.S. Cl. ..... 383/16; 383/13; 383/24; 383/38; 383/67; 383/75

(58) Field of Classification Search ..... 383/72, 383/75, 76, 22, 23, 12, 13, 38, 16, 67, 24
See application file for complete search history.

(56) References Cited

U.S. PATENT DOCUMENTS

| | | | | |
|---|---|---|---|---|
| 1,224,568 | A * | 5/1917 | Ream | 141/390 |
| 1,564,930 | A * | 12/1925 | Boyes | 383/23 |
| 2,437,149 | A * | 3/1948 | Baxter | 383/38 |
| 2,578,391 | A * | 12/1951 | Behr | 294/169 |
| 2,697,465 | A * | 12/1954 | Johnson | 383/4 |
| 2,704,098 | A * | 3/1955 | Pocock | 383/23 |
| 2,815,785 | A * | 12/1957 | Vail | 383/13 |
| 3,132,794 | A * | 5/1964 | Frazier | 383/22 |
| 4,674,664 | A * | 6/1987 | Simon | 224/604 |
| 4,773,585 | A * | 9/1988 | Lehrman | 232/1 B |
| 5,050,998 | A * | 9/1991 | Wachtel | 383/6 |
| 5,490,619 | A * | 2/1996 | Boyar | 224/153 |
| 5,503,476 | A * | 4/1996 | Hamdan | 383/9 |
| D369,467 | S * | 5/1996 | Cole | D3/300 |
| 6,564,838 | B1 * | 5/2003 | Cruickshank | 150/118 |
| 6,659,273 | B1 * | 12/2003 | Scola | 206/285 |
| 2004/0155077 | A1 * | 8/2004 | Cullen et al. | 224/153 |
| 2010/0224515 | A1 * | 9/2010 | Siegel et al. | 206/279 |

* cited by examiner

*Primary Examiner* — Jes F Pascua
(74) *Attorney, Agent, or Firm* — David B. Tingey; Kirton & McConkie

(57) ABSTRACT

Systems and methods for providing a dynamic laundry bag apparatus that is lightweight, sorts laundry, and facilitates the carrying of laundry to a laundry facility or the packing of laundry when traveling. A laundry bag slips onto the lock bar of a hanger to be placed in a hanging position. The bag sorts laundry. For transporting the laundry, the laundry bag can be slipped off the hanger. A drawstring at the top of the bag is pulled and fastened into a snap hook to create a shoulder strap. In cleaning the laundry, the bag may be washed with the laundry. The bag can similarly be used to transport the clean laundry, and can be placed back on the lock bar of the hanger. Clean shirts can be hung over the hanger and/or clean pants can be hung over the lock bar to prevent wrinkles as the laundry is being transported.

13 Claims, 9 Drawing Sheets

SYSTEMS AND METHODS FOR PROVIDING A DYNAMIC LAUNDRY BAG APPARATUS

RELATED APPLICATIONS

This application claims priority to U.S. Provisional Patent Application Ser. No. 60/735,090 filed Nov. 8, 2005, entitled SYSTEMS AND METHODS FOR PROVIDING A DYNAMIC LAUNDRY BAG APPARATUS.

BACKGROUND OF THE INVENTION

1. Field of the Invention

The present invention relates to laundry bags. In particular, the present invention relates to systems and methods for providing a dynamic laundry bag apparatus that is lightweight, sorts laundry, and facilitates the carrying of laundry to a laundry facility or the packing of laundry when traveling. The laundry bag apparatus converts from a hanging laundry bag to an easily transportable duffle bag.

2. Background and Related Art

Current containers available for holding laundry include hampers, baskets and bags. Such laundry containers have proven to be bulky, cumbersome or otherwise difficult to carry. Additionally, some laundry containers (e.g., laundry hampers) are configured to receive dirty laundry while other laundry containers (e.g., baskets) are used to transport the dirty laundry to a laundry facility.

Thus, while techniques currently exist that are used to hold and/or transport laundry, challenges still exist. Accordingly, it would be an improvement in the art to augment or even replace current techniques with other techniques.

SUMMARY OF THE INVENTION

The present invention relates to laundry bags. In particular, the present invention relates to systems and methods for providing a dynamic laundry bag apparatus that is lightweight, sorts laundry, and facilitates the carrying of laundry to a laundry facility or the packing of laundry when traveling. The laundry bag apparatus converts from a hanging laundry bag to an easily transportable duffle bag.

Implementation of the present invention takes place in association with a laundry bag that slips onto the lock bar of a hanger. In addition to supporting the laundry bag, the hanger may be used to support laundered shirts and/or pants. Some embodiments divide and sort laundry, such as light colored laundry from dark colored laundry. Other embodiments are just for whites, while other embodiments combine all laundry types into one bag.

For transporting the laundry, such as transporting the laundry to a laundry facility, the laundry bag can be slipped off the hanger. A drawstring at the top of the bag may be pulled and fastened into a snap hook to create a shoulder strap. In cleaning the laundry, the bag may also be washed with the laundry. The bag can similarly be used to transport the clean laundry, and can be placed back on the lock bar of the hanger. Clean shirts can be hung over the hanger and/or clean pants can be hung over the lock bar to prevent winkles as the laundry is being transported.

While the methods and processes of the present invention have proven to be particularly useful in the area of holding, separating and/or carrying laundry, those skilled in the art can appreciate that the methods and processes can be used in a variety of different applications and in a variety of different areas of manufacture to yield a dynamic container that enables sorting, storing and transporting items.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

The present invention relates to laundry bags. In particular, the present invention relates to systems and methods for providing a dynamic laundry bag apparatus that is lightweight, sorts laundry, and facilitates the carrying of laundry to a laundry facility or the packing of laundry when traveling. The laundry bag apparatus converts from a hanging laundry bag to an easily transportable duffle bag.

Embodiments of the present invention take place in association with a laundry bag that selectively couples to the lock bar of a hanger. In addition to supporting the laundry bag, the hanger may be used to support laundered shirts and/or pants. Some embodiments divide and sort laundry, such as light colored laundry from dark colored laundry. Other embodiments are just for whites, while other embodiments combine all laundry types into one bag.

For transporting the laundry, such as transporting the laundry to a laundry facility, the laundry bag can be slipped off the hanger. A drawstring at the top of the bag may be pulled and fastened into a snap hook to create a shoulder strap. In cleaning the laundry, the bag may also be washed with the laundry. The bag can similarly be used to transport the clean laundry, and can be placed back on the lock bar of the hanger. Clean shirts can be hung over the hanger and/or clean pants can be hung over the lock bar to prevent winkles as the laundry is being transported.

Figure 1:
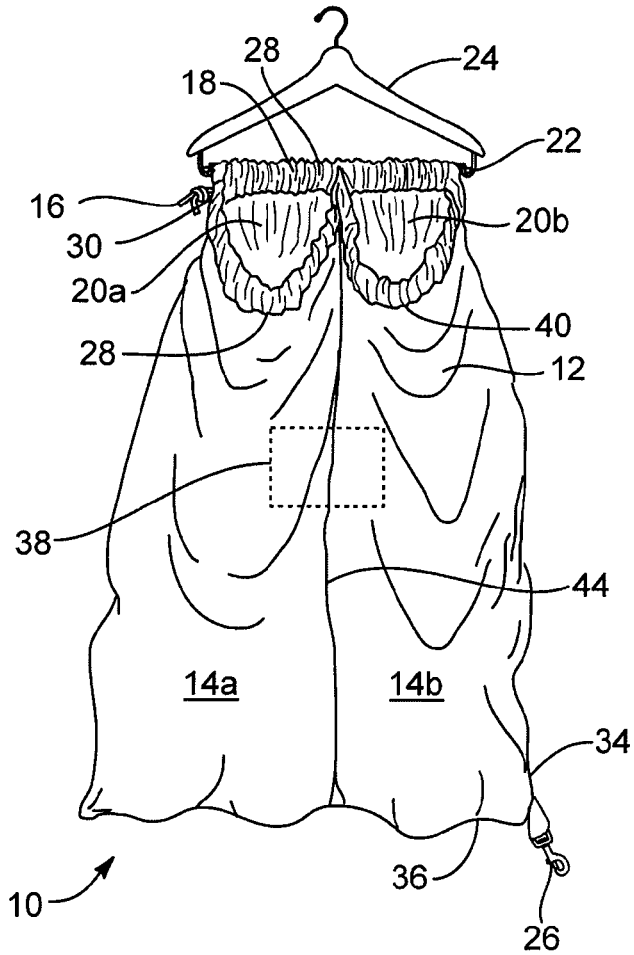
FIG. 1 illustrates a front view of a representative system in a hanging position in accordance with an embodiment of the present invention.
Figure 2:
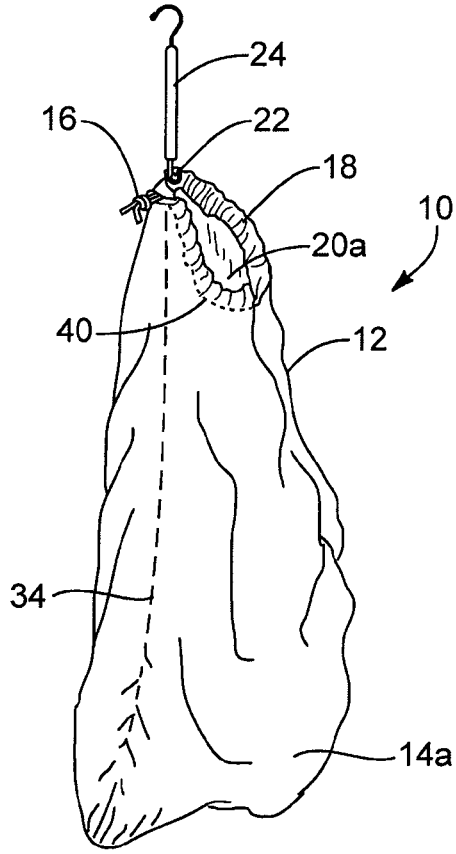
FIG. 2 illustrates a side view of the representative system of FIG. 1.

With reference now to FIGS. 1-2, a representative dynamic laundry bag apparatus is illustrated as dynamic laundry bag 10 in a hanging position. FIG. 1 illustrates a front view and FIG. 2 illustrates a side view of the dynamic laundry bag 10.

Dynamic laundry bag 10 comprises bag 12 having one or more sections 14, closure device 16 and channel 18, wherein each section includes an opening 20 for receiving laundry, and wherein channel 18 is configured to selectively couple laundry bag 10 to a lock bar 22 of a hanger 24. Dynamic laundry bag 10 further includes fastening device 26 coupled to bag 12, wherein the fastening device 26 is configured to be selectively coupled to closure device 16 to transition the dynamic laundry bag 10 between a hanging position and a transporting position, as will be discussed below.

Figure 16:
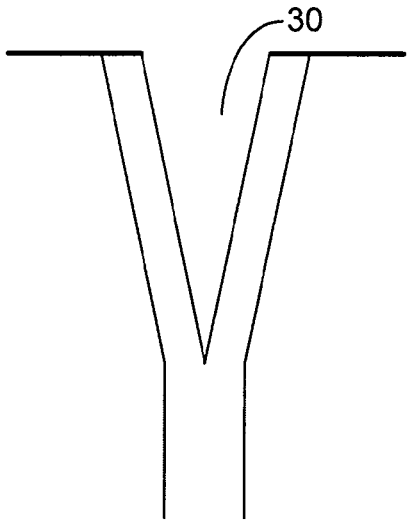

In the illustrated embodiment, bag 12 includes a 2" casing 28 for a closure device 16 and lock bar 22 to be threaded there through. Furthermore, in the illustrated embodiment, closure device 16 is a drawstring. Bag 12 further includes a placket 30. (Manufacturing instructions for placket 30 is provided below in connection with FIG. 16.)

Those skilled in the art will appreciate that a variety of fastening devices may be used in accordance with the embodiments of the present invention. In the illustrated embodiment, fastening device 26 is a snap hook that is fastened or otherwise coupled to bag 12 through by use of a 2" piece of webbing sewn into a side seam 34 of bag 12. Bottom hem 36 and side seams 34 are surged and sewn. A pocket may optionally be included to bag 12, such as at location 38. In the illustrated embodiment, the seam is sewn down the middle of bag 12 to form two separate compartments for sections 14 in bag 12. Additionally illustrated is hemline 40 for casing 28.

Figure 3:
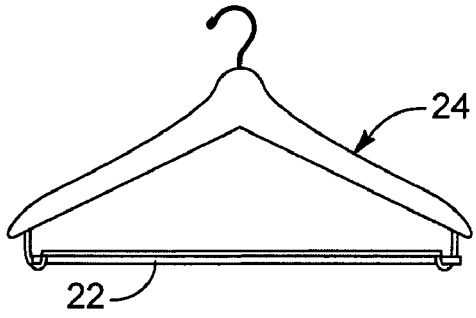
FIG. 3 illustrates a representative hanger having a lock-bar that may be used in association with the representative embodiment of FIG. 1.

With reference to FIG. 3, a representative hanger 24 having a lock-bar 22 is illustrated that may be used in association with the representative embodiment of FIGS. 1-2. Locking bar 22 is used to slip the bag on to use as hanging laundry bag. Thus, in at least some embodiments, a dynamic laundry bag includes a divided or single laundry compartment, wherein a portion of the bag that slips onto a pant bar or locking bar of a hanger. In other embodiments, a dynamic laundry bag is selectively coupled to a heavy duty plastic or metal hanger with a lift bar to place the bag in a hanging position.

Figure 4:
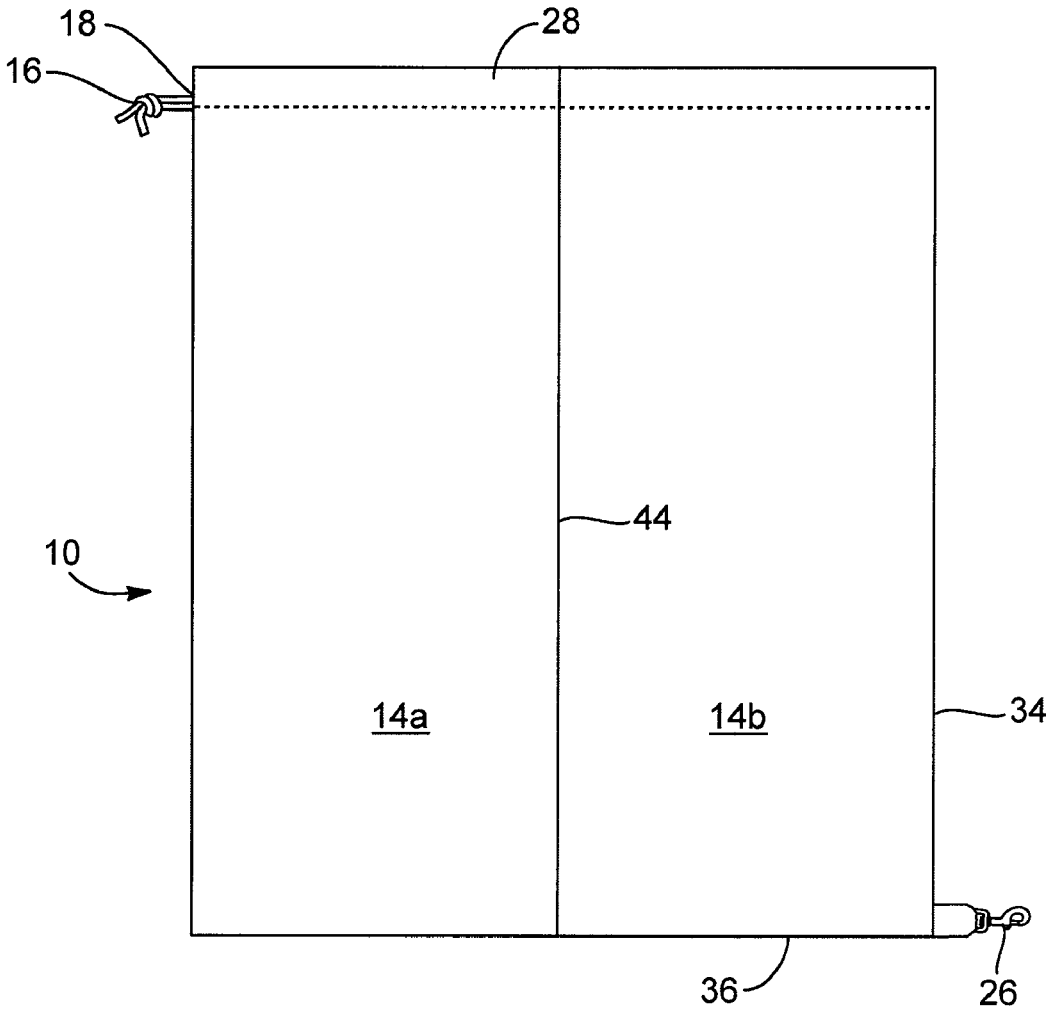
FIG. 4 illustrates a front view of the embodiment of FIG. 1 that has been decoupled from the representative hanger of FIG. 3.

FIG. 4 illustrates a front view of bag 12, which has been decoupled from hanger 24 (FIG. 3) and laid flat. As mentioned above, bag 12 comprises a middle seam 44 that separates bag 12 in to two sections 14. Those skilled in the art will appreciate that while the representative embodiment illustrates two laundry sections (i.e., sections 14*a* and 14*b*), embodiments of the present invention embrace less than two sections or more than two sections.

Figure 5:
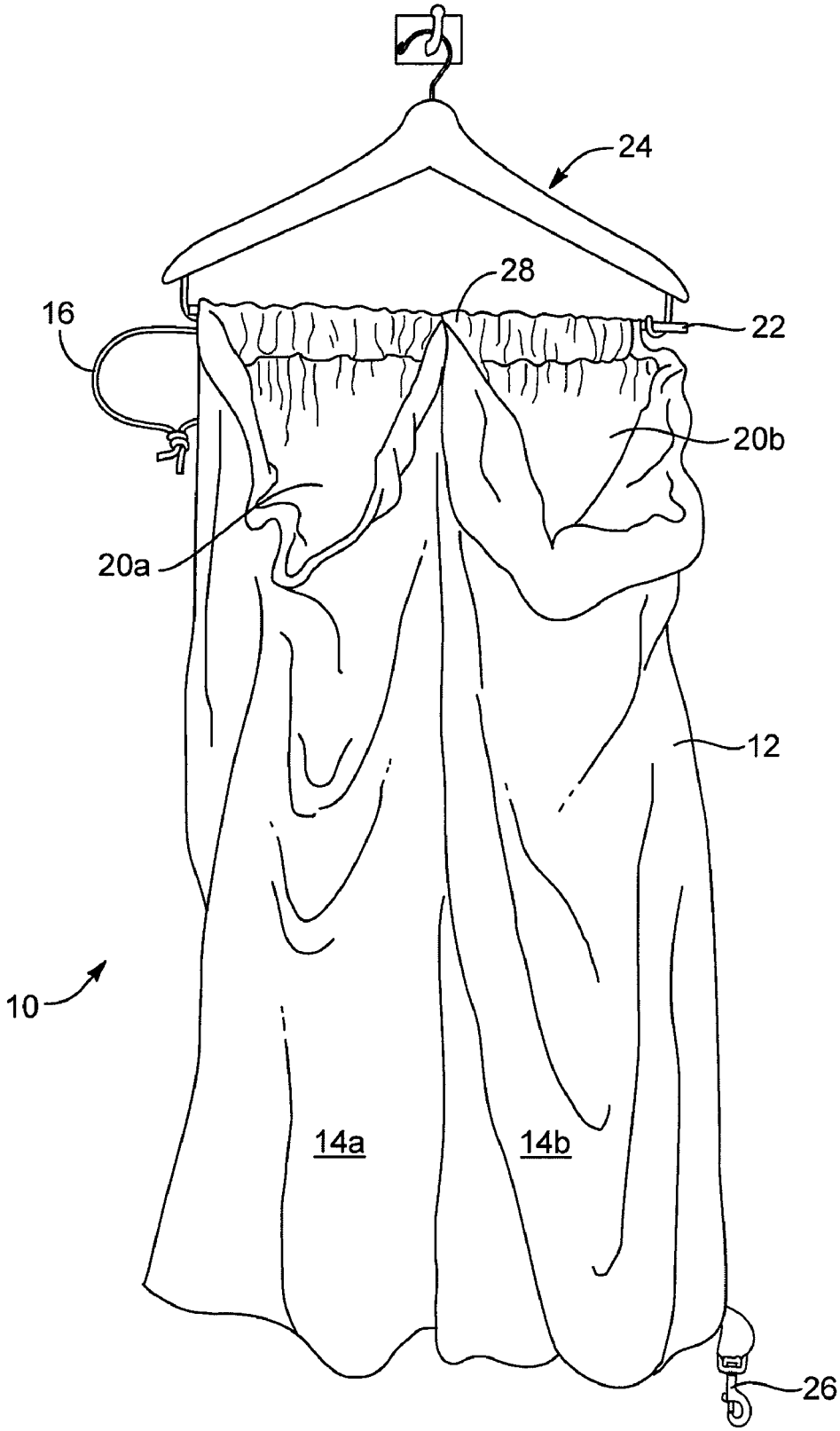
FIG. 5 illustrates another representative system in a hanging position in accordance with an embodiment of the present invention.

FIG. 5 illustrates another representative dynamic laundry bag in a hanging position in accordance with an embodiment of the present invention. In FIG. 5, the divided bag has one side of the bag that is made of light colored (e.g. white or another color) sports mesh or small porthole fabric to hold white and light colored clothing. The other side is made of a darker colored sports mesh or small porthole fabric for holding colored clothing. The color-coordinated sections facilitate washing the laundry wince the clothing is presorted. In the illustrated embodiment, the back of the laundry bag is made of sports mesh or small porthole fabric matching the darker colored front side. The sports mesh or small porthole fabric is used as it allows air to circulate around the laundry to minimize mildew formation.

Figure 6:
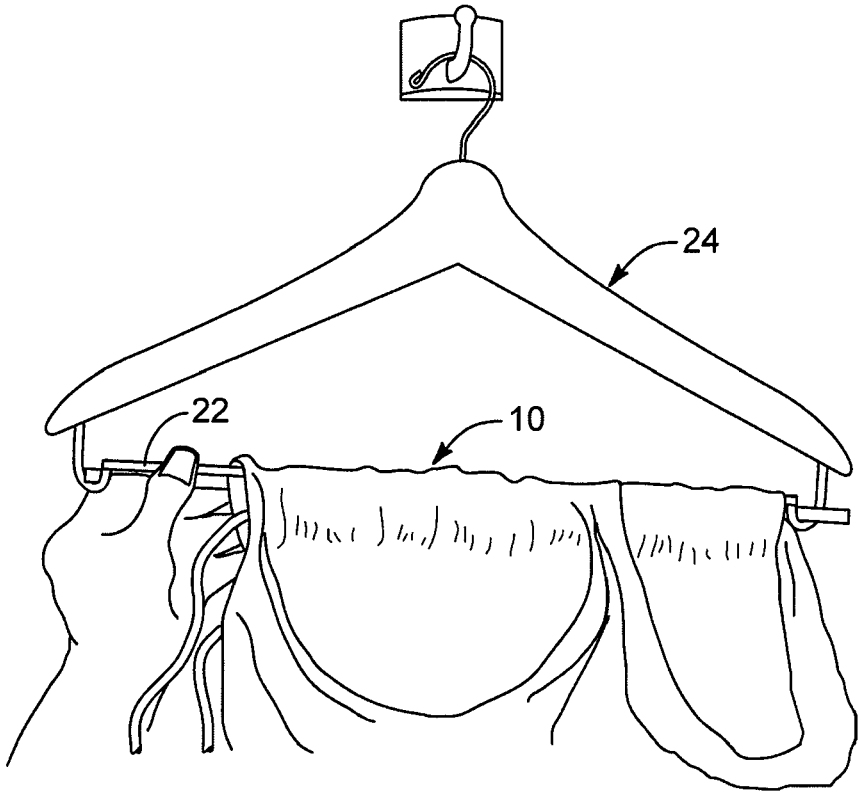
FIG. 6 illustrates a representative manner of unlocking a lock-bar of a hanger.
Figure 7:
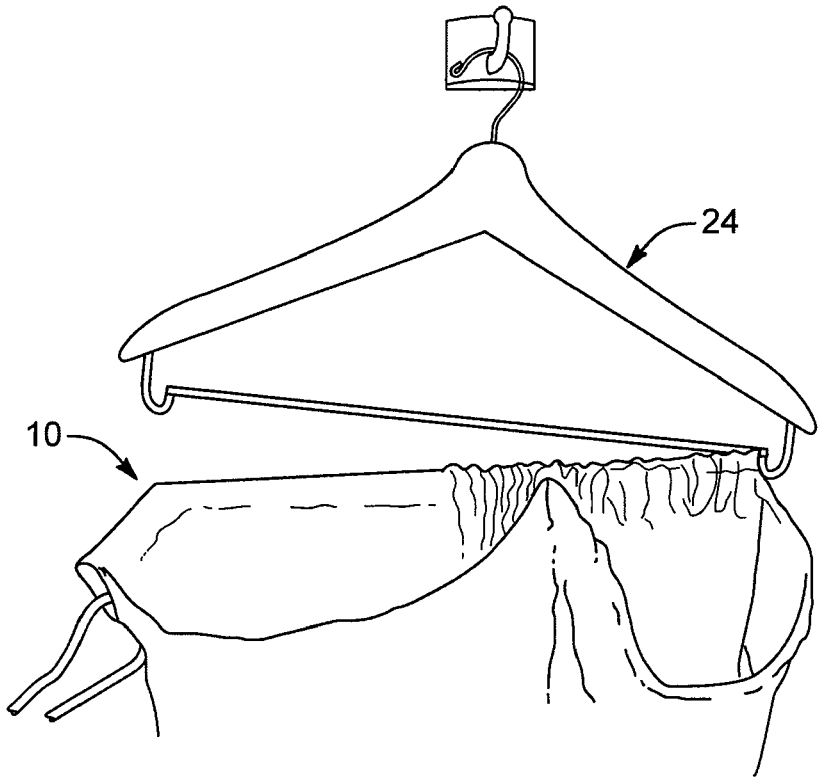
FIG. 7 illustrates a representative manner of decoupling from a hanger.

The top of the bag has a drawstring closure allowing the bag to be removed from the hanger by unlatching the wooden pant bar (see FIG. 6) and pulling the laundry bag off the hanger bar (see FIG. 7) if one chooses to carry it as a duffle bag without the hanger. Removal of the bag from the hanger also allows the bag itself to be laundered.

Figure 8:
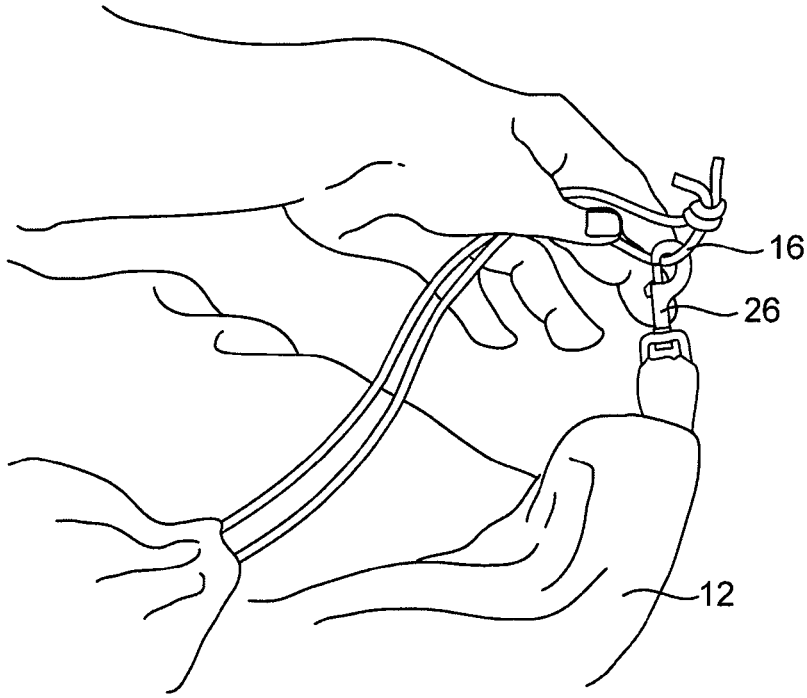
FIG. 8 illustrates a representative manner of coupling a drawstring to form a carrying strap.
Figure 9:
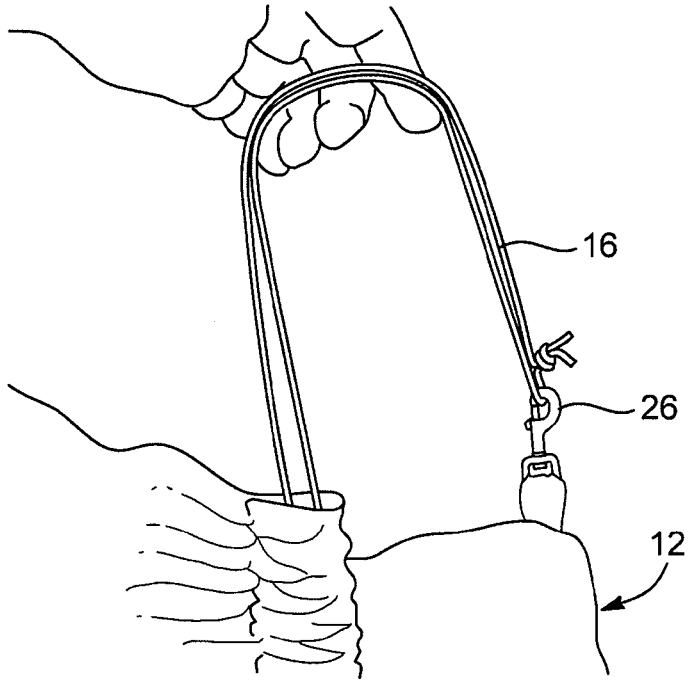
FIG. 9 further illustrates a representative carrying strap.

Once the bag is removed from the hanger and the drawstring is pulled tight, the drawstring may be pulled down to the bottom corner opposite the side from which the drawstring is pulled and placed into a snap hook (see FIG. 8) to form a carrying strap (see FIG. 9). Accordingly, the bag is placed in a transporting position (see FIG. 10). The bag can subsequently be placed back into a hanging position by sliding a portion of the bag back onto the hanger allowing the dynamic laundry bag to be hung up in a closet or on the back of a door, for example, thus keeping laundry off the floor with light colors and dark colors presorted.

Additionally, when removing laundry from the dryer, shirts can be hung on the hanger and slacks can be hung over the hanger bar to prevent wrinkles in each. In one embodiment, the bag includes a pocket on the front side panel or at another location. Other embodiments include using elastic cording instead of a drawstring, eliminating the casing on the front panels, and/or eliminating the cording or elastic cording altogether.

In one embodiment, a single compartment bag slides onto a hanger and may be made out of various fabrics such as terry cloth or mesh. Further embodiments may include a snap hook, pocket, and/or drawstring. Those skilled in the art will appreciate that embodiments of the present invention embrace a variety of different sizes, dimensions, colors, shapes and/or materials. Additionally, bags may be personalized by the use of machine embroidering or silk screening.

Figure 10:
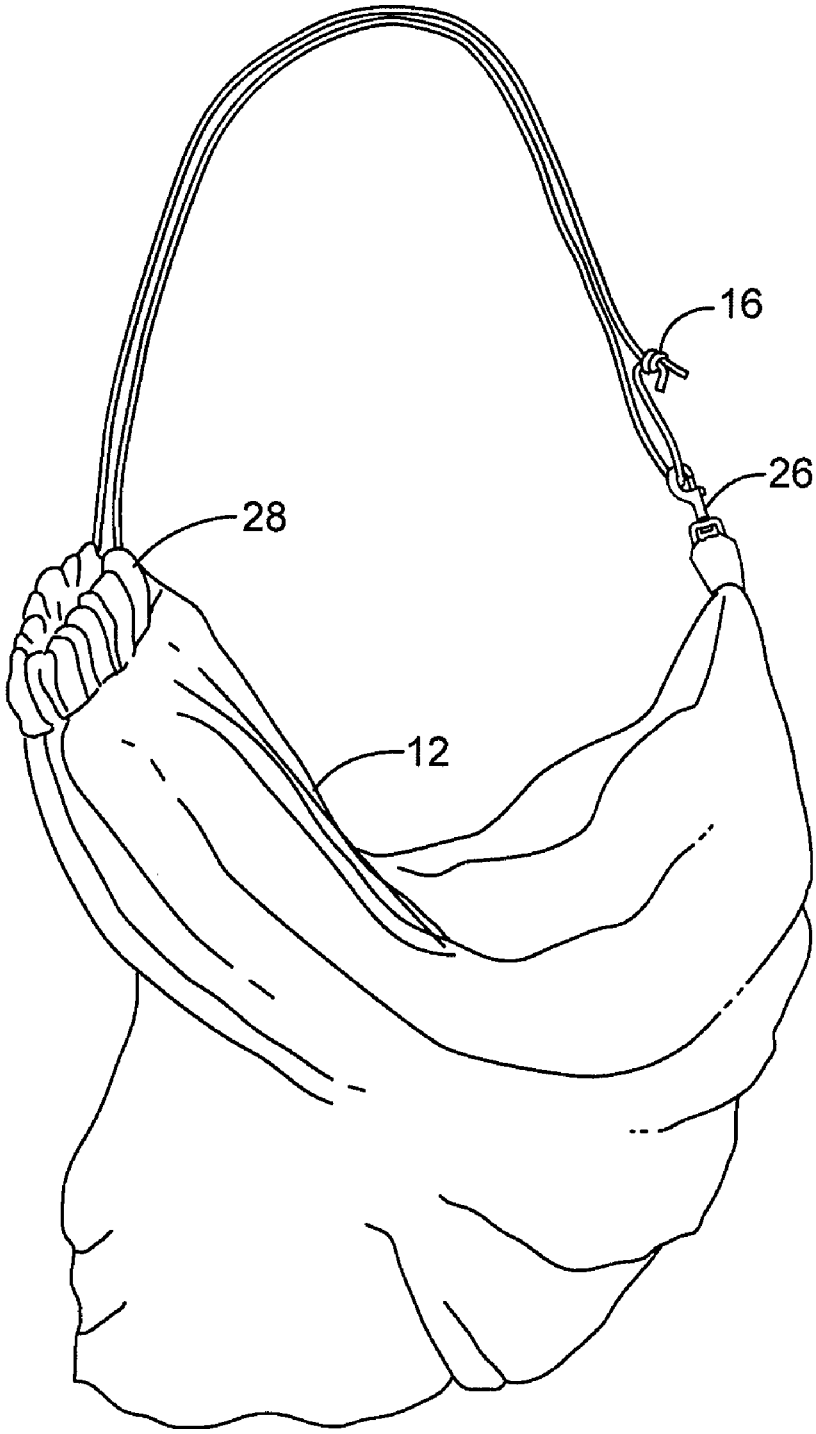
FIG. 10 illustrates a representative embodiment of the present invention in a transporting position.

Thus, FIG. 10 illustrates a representative embodiment of the present invention in a transporting position, wherein the dynamic laundry bag is decoupled from the hanger and ready to carry to the laundry facility. The drawstring has been pulled tight and snapped into the hook on the opposite bottom corner of the bag to form a shoulder strap that facilitates carrying the bag.

The following provides a discussion relating to the manufacturing of a double compartment/section bag and to the manufacturing of a single compartment/section bag. Those skilled in the art will appreciate that other embodiments embrace more than two compartments and/or compartments that are different in size with respect to each other.

In one embodiment, a double compartment bag is manufactured using white tricot sports mesh (e.g., one (1) yard, sixty (60) inches wide), colored tricot sports mesh (e.g., one (1) yard, sixty (60) inches wide), cable cording (e.g., size 150, two and one quarter (2¼) yards in length), and one (1) suit hanger.

Figure 11:
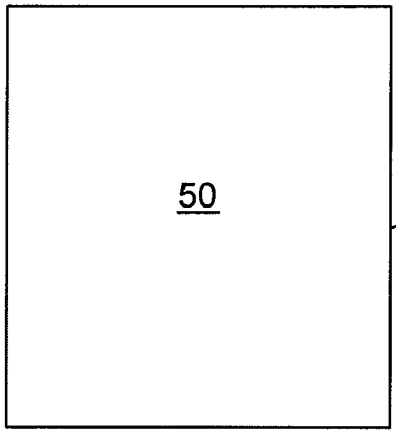
FIG. 11 illustrates a piece of material for use as a side front piece of an embodiment of the present invention.
Figure 13:
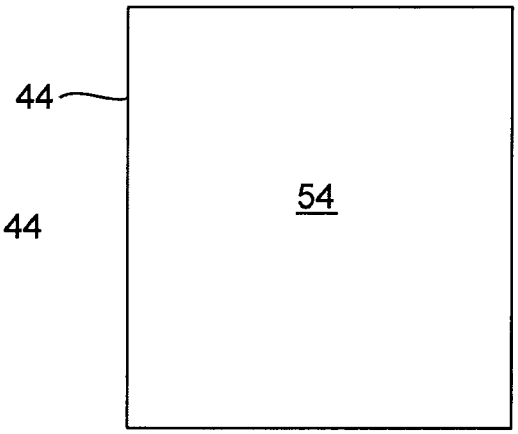
FIG. 13 illustrates a piece of material for use as a side front piece of an embodiment of the present invention.
Figure 12:
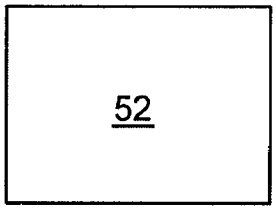
FIG. 12 illustrates a piece of material for use as a pocket of an embodiment of the present invention.
Figure 14:
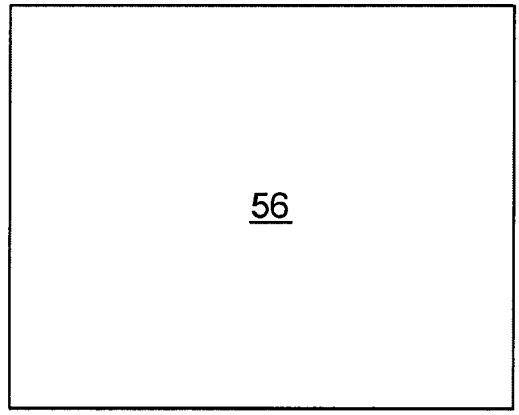
FIG. 14 illustrates a piece of material for use as a back piece of an embodiment of the present invention.

All widths are cut on the stretch grain. With regard to the white fabric, a side front piece 50 is cut eighteen and one fourth (18¼) inches wide and thirty-six (36) inches long (see FIG. 11). If a pocket is to be included, the pocket 52 is cut, for example, twelve (12) inches wide and twelve (12) inches long (see FIG. 12). With regard to the colored fabric, a side front piece 54 is cut eighteen and one fourth (18¼) inches wide and thirty-six (36) inches long (see FIG. 13). The back piece 56 is cut thirty-six (36) inches wide and thirty-six (36) long (see FIG. 14).

Those skilled in the art will appreciate that the dimensions provided are for illustrative purposes only, and that embodiments of the present invention embrace other dimensions, shapes and/or materials.

Once the fabric pieces are cut, they may be sewn together in the following manner: With right sides together, the side fronts are sewn and serged together at center seams. The edges of sides, top, and bottom of front piece are serged. The sides, top, and bottom of back piece are serged. All sides of pocket piece are serged. A two (2) inch hem is made in the top of the pocket. The sides and bottom are folded under one half (½) inch and pressed. If a name, saying and/or graphic is to be embroidered or otherwise placed on the pocket, it may be done prior to or after sewing on the pocket.

Figure 15:
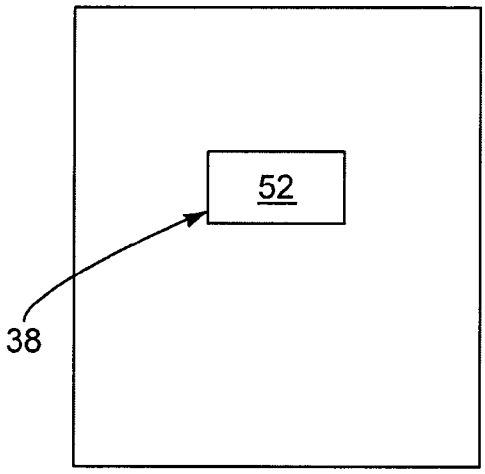
FIG. 15 illustrates a representative manner for including a pocket.

The pocket is attached to the center of the side front (see FIG. 15). The bottom of the bag is sewn with right sides together. The front and back are sewn together with the right sides together, leaving four (4) inches open at the top. The side seams are pressed open. A seam is sewn one fourth (¼) inch from the edge down from the top and across the bottom of the opening and back up to top (see FIG. 16). The top is folded down to make a two (2) inch hem. The hem is sewn leaving all four (4) sides open to insert the cable cording.

Those skilled in the art will appreciate that the representative method discussed above is provided for illustration purposes only. Accordingly, embodiments of the present invention embrace a variety of manufacturing methods providing a laundry bag apparatus in accordance with an embodiment of the present invention.

Figure 17:
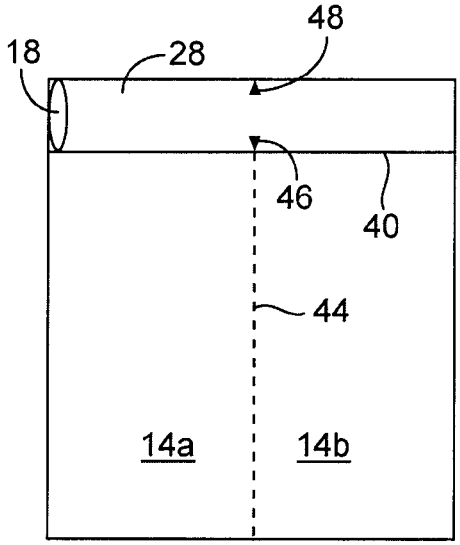
FIGS. 16-17 illustrate a representative manner for creating a location for a drawstring.

The bag is turned right side out, and the bag is pressed. Starting at the bottom of the bag, a seam is sewn through the back and the front up the center of the bag until the hem lime is reached at the top. The bottom and top of the hem line is well tacked (as shown at 46 and 58), leaving the center open for the cable chording (see FIG. 17). The cable cording is inserted starting through the front hem and continuing through to the back hem. The hanger lock bar is inserted through the back hem.

In another embodiment, a single compartment bag is manufactured using white tricot sports mesh (e.g., two (2) yards, thirty (30) inches wide), cable cording (e.g., size 150, two (2) yards in length), and one (1) hanger.

All widths are cut on the stretch grain. One piece is cut thirty (30) inches wide and sixty (60) inches long. All sides are serged. The piece is folded in half with right sides together making a thirty (30) inch square. The side seams are sewn leaving four (4) inches open at the top. The side seams are pressed open. A seam is sewn one fourth (¼) inch from edge down from the top and across the bottom of the opening and back up to top (see FIG. 16). The top is folded down to make a two (2) inch hem. The hem is sewn leaving all four (4) sides open to insert cable cording.

The cable cording is inserted starting through front hem and continuing through to back. The lock bar of the hanger is inserted through the back hem. A name may be embroidered on the front.

Accordingly, in at least some embodiments, a hanging, divided laundry bag is provided that slips onto a pant bar of a hanger. One side of the bag is made of light colored sports mesh or small porthole fabric to hold white and light colored clothing. The other side is made of a darker colored sports mesh or small porthole fabric for holding colored clothing, making it much easier to do laundry with the clothing being presorted. The back of the laundry bag is made of sports mesh or small porthole fabric matching the darker colored front side. The sports mesh or small porthole fabric used allows air to circulate around the laundry to minimize mildew formation. The top of the bag has a drawstring closure allowing the bag to be removed from the hanger by unlatching the wooden pant bar and pulling off the laundry bag if one chooses to carry it as a duffle bag without the hanger and also allowing the bag itself to be laundered. There is a snap hook sewn into the side seam at the bottom on the opposite corner from the draw string. This allows for the drawstring to be placed into the snap hook forming a shoulder strap for easier carrying. The bag is easy to slide back onto the hanger allowing the laundry bag to be hung up in a closet or on the back of a door, thus keeping laundry off the floor with light colors and dark colors presorted. When removing laundry from the dryer shirts can be hung on the hanger and slacks can be hung over the hanger bar to prevent wrinkles. The bag also has an optional pocket on the front side panel.

Figure 18:
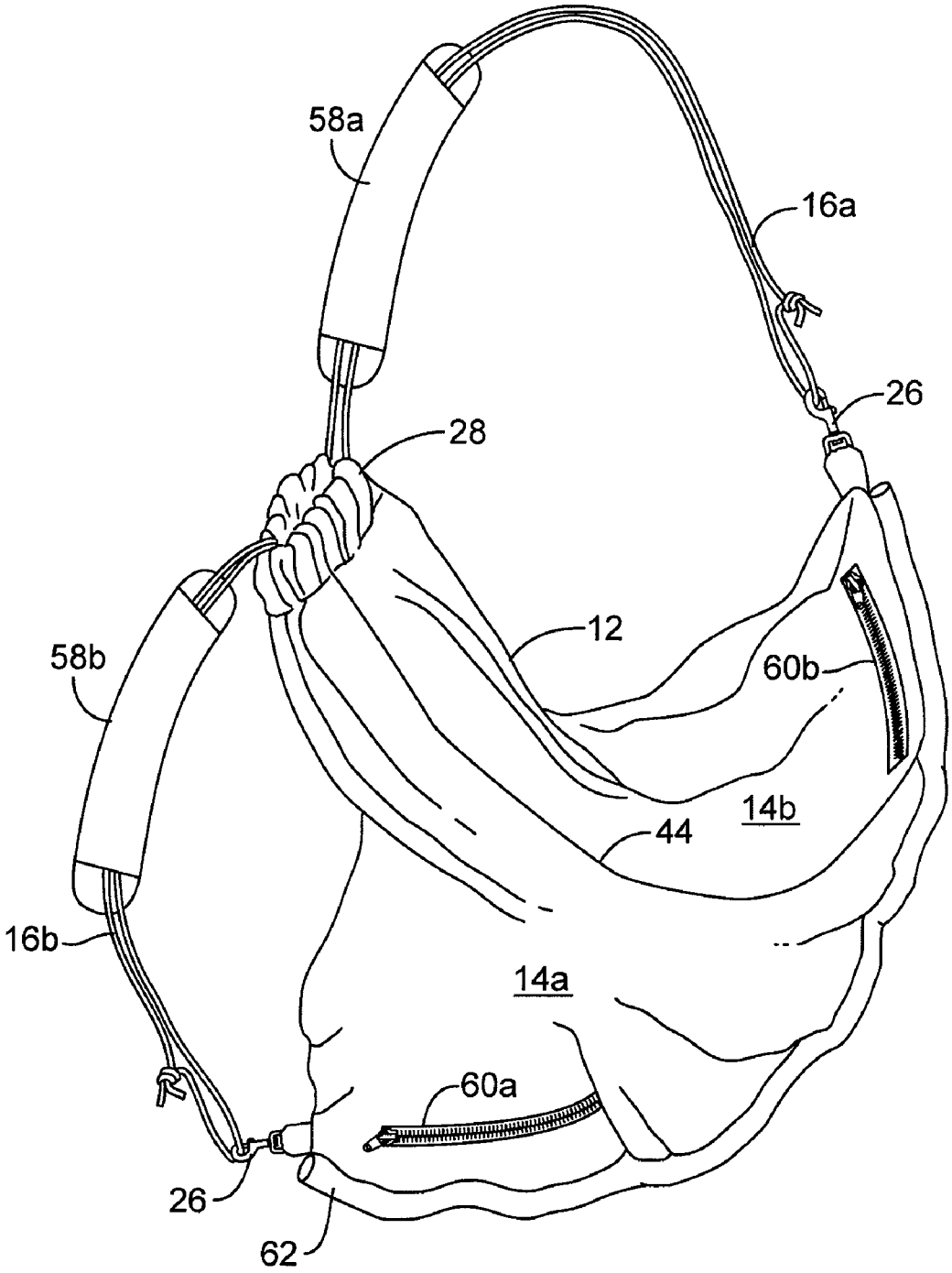
FIG. 18 illustrates a representative system comprising a plurality of fastening devices.

In some embodiments, a shoulder pad 58 (see FIG. 18) is selectively coupled to a carrying strap (e.g., closure device 16) to provide added comfort to the user transporting the bag. Also, some embodiments embrace the use of a flat hanger, a coat hanger, a metal hanger, a wood hanger and/or a plastic hanger. In some embodiments, a pocket or section is provided to contain laundry supplies and/or coins for use at a laundry facility.

In one embodiment, an opening 60 (see FIG. 18) is provided at the bottom of the bag 12, such as with the use of a zipper, pull cord, or other device, that allows for a user to selectively open a bottom portion of a section to allow the laundry or other items contained therein to be removed through the bottom of the bag.

In a further embodiment, a fastening device (e.g., fastening device 26 of FIG. 1) is used to hang a dynamic laundry bag (e.g., dynamic laundry bag) upside down, such as from a clip, a rod, a hanger, or other structure, to allow the user to selectively open a section and allow the laundry or other items contained therein to be easily removed from the bag.

In another embodiment, a channel 62 (see FIG. 18) is provided at or near a bottom portion of a dynamic laundry bag that is configured to selectively receive a lock bar of a hanger. Accordingly, a hanger may be used to hang a dynamic laundry bag right-side-up or alternatively upside-down.

In another embodiment, a dynamic laundry bag does not include a fastening device, such as fastening device 26 of FIG. 1.

In one embodiment, delicate clothing is placed into the dynamic laundry bag and the bag and delicate clothing are washed together. Accordingly, the dynamic laundry bag allows for the delicate clothing to be cleaned, but protects the material during the cleaning process.

In one embodiment, a handle is coupled to an outside surface of a dynamic laundry bag. In another embodiment, a clasp is used instead of a knot of a pull cord.

In some embodiments, the dynamic laundry bag includes a plurality of fastening devices. For example, in one embodiment, a first fastening device (e.g., fastening device 26 of FIG. 1) is coupled to a first location of bag 12 and a second fastening device (not shown) is coupled to a second location of bag 12. Accordingly, the fastening devices of the dynamic laundry bag are configured to be selectively coupled to one or more closure devices, such as closure device 16, to transition the dynamic laundry bag between a hanging position and a transporting position. In a further embodiment, the transporting position includes one or more carrying loops for a user. In one embodiment, the multiple loops are formed to place over the users shoulders in order to carry/transport the dynamic laundry bag on the user's back.

Thus, as discussed herein, embodiments of the present invention embrace laundry bags. In particular, the present invention relates to systems and methods for providing a dynamic laundry bag apparatus that is lightweight and facilitates the carrying of laundry to a laundry facility or the packing of laundry when traveling. The laundry bag apparatus converts from a hanging laundry bag to an easily transportable duffle bag.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A laundry bag apparatus, comprising:

a front panel and a back panel, wherein the front panel is connected to the back panel at a first lateral edge, a second lateral edge, and a bottom end, wherein a seam disposed between the first lateral edge and the second lateral edge further connects the front panel to the back panel and forms a plurality of compartments that each comprise a first opening for receiving laundry, wherein the front panel comprises a front channel that is disposed towards a top end of the bag, and wherein the back panel comprises a back channel that is disposed towards the top end and that is sized and shaped to selectively receive a lock bar of a hanger;

a closure device that extends through the front channel and the back; and a bottom channel that is disposed towards the bottom end of the bag and which is sized and shaped to selectively receive the lock bar of the hanger.

2. The laundry bag of claim 1, wherein the bag further comprises a fastening device that is coupled to a first corner at the bottom end of the bag.

3. The laundry bag of claim 2, wherein the closure device extends from a second corner that is opposite to the first corner, and wherein the fastening device is configured to be selectively coupled to the closure device to transition the bag between a hanging position and a transporting position.

4. The laundry bag of claim 1, the bag further comprises a lock bar of a hanger is selectively received within the back channel.

5. The laundry bag of claim 1, wherein the seam extends between the bottom end and the back channel but does not close the back channel.

6. The laundry bag of claim 1, wherein the bag further comprises a shoulder pad that is disposed on the closure device.

7. The laundry bag of claim 1, wherein each of the plurality of compartments comprises a second opening disposed towards the bottom end of the bag.

8. A laundry bag apparatus, comprising:

a font panel and a back panel, wherein the front panel is connected to the back panel at a first lateral edge, a second lateral edge, and a bottom end, wherein the front panel comprises a front channel that is disposed towards a top end of the bag, and wherein the back panel comprises a back channel that is disposed towards the top end and that is sized and shaped to selectively receive a lock bar of a hanger;

a first closure device that extends through the front channel and the back channel and from a first corner at the top end of the bag;

a first fastening device that is coupled to a second corner at the bottom end of the bag, wherein the second corner is opposite to the first corner, and wherein the first fastening device is configured to be selectively coupled to the first closure device to transition the bag between a hanging position and a transporting position; and a bottom channel that is disposed towards the bottom end of the bag and which is sized and shaped to selectively receive the lock bar of the hanger.

9. The laundry bag of claim 8, further comprising a seam that is disposed between the first lateral edge and the second lateral edge, wherein the seam connects the front panel to the back panel and forms a plurality of compartments that each comprise an opening for receiving laundry.

10. The laundry bag of claim 9, wherein the seam extends between the bag's bottom end and the back channel and does not close the back channel.

11. The laundry bag of claim 8, wherein the bag further comprises a lock bar of a hanger is selectively received within the back channel.

12. The laundry bag of claim 8, wherein the laundry bag further comprises a shoulder pad that is disposed on the first closure device.

13. The laundry bag of claim 8, wherein the bag further comprises a second fastening device coupled to the bag, wherein the second fastening device is configured to be selectively coupled to the first closure device or to a second closure device that is connected to the bag so as to transition the bag between the hanging position and the transporting position, wherein the transporting position includes one or more carrying loops that are configured to be placed on a user's shoulders.

* * * * *